United States Patent [19]

Volkmar et al.

[11] 4,454,393

[45] Jun. 12, 1984

[54] ELECTROHYDRAULIC SWITCHING DEVICE

[75] Inventors: Werner Volkmar, Idstein-Walsdorf; Bernd Schütt, Oberursel-Weisskirchen, both of Fed. Rep. of Germany

[73] Assignee: ITT Industries, Inc., New York, N.Y.

[21] Appl. No.: 411,756

[22] Filed: Aug. 26, 1982

[30] Foreign Application Priority Data

Oct. 14, 1981 [DE] Fed. Rep. of Germany ..... 3140800

[51] Int. Cl.[3] ..... H01H 35/38

[52] U.S. Cl. ..... 200/82 R; 200/82 C

[58] Field of Search ..... 200/82 R, 82 C, 82 A

[56] References Cited

U.S. PATENT DOCUMENTS

| | | | |
|---|---|---|---|
| 2,292,546 | 8/1942 | Rockwell | 200/82 C |
| 2,759,061 | 8/1956 | Edelman | 200/82 C |
| 3,175,061 | 3/1965 | Roberts et al. | 200/82 R |
| 3,275,769 | 9/1966 | Weaver | 200/82 R |
| 3,405,244 | 10/1968 | Collins | 200/82 R |
| 3,614,352 | 10/1971 | Wiese | 200/82 C |
| 3,746,810 | 7/1973 | Parsons et al. | 200/82 R |
| 4,256,933 | 3/1981 | Choe | 200/82 R X |

*Primary Examiner*—J. R. Scott

*Attorney, Agent, or Firm*—James B. Raden; William J. Michals

[57] ABSTRACT

An electrohydraulic switching device adapted to supply electric control signals in dependence on pressure signals received includes a first piston adapted to be acted upon by the input pressure and spring-loaded in opposition to the input pressure, and a second piston positively engaged with the first piston to activate an electric switching element. The first and second pistons are axially slidable relative to each other by a predetermined distance. A retaining element engages the second piston to provide for a switch hysteresis. To avoid an impact on the limit values as a result of fluid temperature and viscosity variations, the second piston is carried in the retaining element by several circumferentially spaced contact points in that the retention element is an elastic, substantially annular body with open ends. A third piston operative for actuating a second switching element connected to a warning device surrounds the second piston and can be entrained by the latter for movement therewith away from the second switching element against the force of an additional spring.

26 Claims, 2 Drawing Figures

ELECTROHYDRAULIC SWITCHING DEVICE

BACKGROUND OF THE INVENTION

The present invention relates to an electrohydraulic switching device adapted to issue electric control signals in response to pressure signals received thereby.

There is already known a device of this type including a first piston adapted to be acted upon by the input pressure and spring-loaded in opposition to the input pressure, and a second piston positively engageable with the first piston to activate an electric switching element, wherein the pistons are axially slidable against each other by a determined distance and a friction member engages the circumferential surface of the second piston to generate a switch hysteresis.

One construction of the switching device of this type consists essentially of two cylinder bores coaxially arranged in a housing, of which one is supplied with the pressure derived from a pressure accumulator. This cylinder bore accommodates a first piston acted upon by the force of a spring in opposition to the input pressure and extending with one of its ends into the second cylinder bore. An end wall is arranged between the cylinder bores, being sealed by a suitable sealing material to prevent the passage of pressurized fluid from the first to the second cylinder bore.

When pressure is supplied to the first cylinder bore, the first piston will be displaced against the force of the spring until the end of the first piston that is arranged in the second cylinder bore engages an abutment surface of the second piston to move the latter, at sufficient pressure in the first cylinder bore, in the direction of an electric switch to thereby cause the issuance of an electric switch signal.

Before the first piston engages the abutment surface of the second piston, a clearance has to be eliminated first. Once the second piston is in an actuating position with the accumulator pressure at its maximum, the pump charging the accumulator will be turned off. The accumulator pressure will be reduced on the withdrawal of fluid from the accumulator. With a reduction in the accumulator pressure, the first piston will be gradually urged into its position of rest by the spring, again performing a lost motion until it is in positive engagement with the second piston and thereby actuates the electric switch to energize the pump.

A spring-loaded friction member engages the circumferential surface of the second piston to hold the latter in the actuating position against the spring force of the contact pin of the electric switch, until the first and second pistons are frictionally engaged. In the switching device described, the upper and lower threshold values of the accumulator pressure are determined by the lost travel between the first and second piston and by the pressurized area of the first piston.

Because of its construction and mode of operation, the switching device described above may be used to control a fluid pump such that the pressure in the accumulator varies between two predetermined threshold or limiting values.

In switching devices of this type, it has been established, however, that a functional interrelationship exists between the actual limiting values of the accumulator pressure and the operating temperature or viscosity of the fluid, which is to be considered to constitute a disadvantage.

SUMMARY OF THE INVENTION

Accordingly, it is a general object of the present invention to avoid the disadvantages of the prior art.

More particularly, it is an object of the present invention to provide an electrodynamic switching arrangement of the type here under consideration which does not possess the disadvantages of the conventional arrangement of this type.

It is yet another object of the present invention to so construct the arrangement of the above type that its operation is virtually independent of the temperature and viscosity of the fluid supplied thereto.

Still another object of the present invention is to so design the arrangement that the levels of the upper and lower threshold pressures remain substantially constant, independent of operating conditions.

A concomitant object of the present invention is to devise an arrangement of the above type which is simple in construction, inexpensive to manufacture, easy to assemble and use, and reliable in operation nevertheless.

In pursuance of these objects and others which will become apparent hereafter, one feature of the present invention resides in an arrangement for issuing electric control signals in dependence on the pressure of a fluid, comprising a housing defining an internal bore centered on an axis; a first piston received in the bore for axial movement; means for applying the pressure of the fluid in one axial direction to the first piston; at least one spring urging the first piston in the other axial direction; a second piston axially movably accommodated in the bore; means for positively entraining the second piston for joint movement with the first piston only after the pistons have axially moved relative to one another within a predetermined range; an electric switch interposed into the path of movement of the second piston for actuation by the latter and operative for issuing the electric control signals in response to such actuation; and means for retaining the second piston against movement with the first piston in the absence of positive entrainment to provide for switch actuation hysteresis, including a preferably resilient generally annular and circumferentially incomplete retaining element frictionally engaging the second piston at a plurality of circumferentially spaced locations and having two end portions circumferentially spaced from one another. When the arrangement is constructed in the above manner, the frictional force exerted on the second piston remains substantially constant, independently of the operating temperature, so that the selected limiting values are maintained constant even under changing conditions as well. As the operating temperature increases, the friction or retaining element will be heated, too, and experience a corresponding change of length. This change of length, however, has no effect on the force exerted on the second piston because the open ends of the friction element permit an elongation of the latter without causing any problems.

In an advantageous further development of the basic concept of the invention, the friction element is of triangular contour, its sides being brought into contact with the second piston. This design enables the second piston to be radially supported in a most simple manner. It is to be understood that the friction element may also have a contour deviating from the triangular form, in which case, however, the forces at the contact points between the friction member and the second piston are less accurately defined.

In an advantageous construction, the friction element is held in a cylindrical bore having a diameter greater than the diameter of the second piston. This ensures that the second piston is located in the cylindrical bore without contacting the wall of the cylindrical bore.

In another advantageous embodiment, the cylindrical bore is the inner circumferential surface of a third piston adapted to actuate a second electric switching element or switch. The third piston is spring-loaded in the actuating direction and adapted for axial abutment with the second piston. In the event of a leak in the hydraulic system which is to be supplied with a hydraulic fluid from the accumulator, in certain circumstances the fluid pump may permanently remain in the on condition, although no accumulator pressure is being built up. In addition to the electric control signals for turning the fluid pump on and off, the above design advantageously provides for generation of a second electric usable signal for actuating a warning device in the event of an inadmissable pressure drop in the hydraulic system or for another purpose.

Actuation of the electric switches or switching elements occurs at different input pressures, with the actuating condition of the second electric switching element being already attained at a lower input pressure. If the design is such that electric current flows through the electric switching elements in the inactive states thereof, both the warning device and the fluid pump will be in operation when the hydraulic system is turned on. With the pressure building up, first the contact of the second actuating device will open and disconnect the warning device. This occurs at a relatively low input pressure level. While the second electric switching element is the first to be actuated with the pressure building up, it will be actuated subsequent to the first electric switching element with the pressure decreasing.

An arrangement which is advantageous from the point of view of production engineering will be accomplished by arranging the third piston coaxially with the second piston. Furthermore, it will be an advantage to use an annular piston as the third piston and to seat the friction member between an inner circumferential surface of the third piston and the circumferential surface of the second piston. In this case, simple turned or otherwise machined parts can be used as pistons. The otherwise present need for providing an additional arrangement for seating the friction member is eliminated. The friction member is advantageously a shaped ring of plastic or steel received in an inner circumferential groove of the third piston.

In a currently preferred construction of the arrangement of this invention, the second piston has at its end close to the switching elements a radially outwardly directed collar engaging behind an annular surface of the third piston that is close to the switching elements. Such a design provides for positive engagement of the second piston with the third piston in a simple manner in the presence of an inadmissible pressure drop in the hydraulic system.

Further, the switching device of this invention may be so designed in accordance with the present invention that the first piston consists of two sections, and that the one section of the first piston is hydraulically sealed to, and extends into, a pressure chamber which is adapted to be pressurized by the input pressure. An end of the one section that is remote from the pressure chamber is in abutment with the other section of the first piston, such second section engaging the second piston from behind. In a further refinement of this aspect of the invention, it will be advantageous to provide the first piston section that is connected to the second piston with a spring plate and to bring the spring plate into engagement with a housing wall in the unpressurized state, with the spring plate being loaded by a spring bearing against a stationary stop or body. The stop for the spring can be made to perform a double function by having a second spring bearing against the stop to load the third piston in the direction of the second electric switching element. The two-part design of the first piston renders any lateral forces of the spring ineffective on the one section of the first piston and thus on the bearing therefor.

Ease of handling of the electrohydraulic switching device is accomplished by accommodating the switching device in a housing having a front port communicating with the pressure chamber and an integrally formed screw thread for connection to a hydraulic system. Similarly, it is conceivable to thread one housing section directly into a hydraulic system, which obviates the need to provide a second housing section and thus results in savings of weight and cost. Further, both electric switching elements are jointly received in a carrier body adapted to be threaded into the housing, with the one electric switching element being centrically arranged in the carrier body.

Preferably, the end of the housing that is remote from the pressure chamber is closed by a cap including one or several openings for the passage of electric lines. In this manner, it is ensured that the electric switching elements are not contaminated. Cost and production advantages will result if the cap is a rotationally symmetrical stamping with a centric opening, and if the section of the cap constituting the opening has a tubular extension, with the electric lines being fixed therein, possibly by means of a shaped rubber part. In this case, the need to provide a special pull-relief for the electric lines is eliminated.

In order to ensure safe switching of the second electric switching element, the force of the second spring is greater than the actuating force of the second electric switching element. Thus, with pressure building up in the hydraulic system, the second electric switching element will already be actuated when the second and third pistons are still in positive engagement. Only when the entire actuating travel of the second switching element is overcome will the positive engagement be discontinued.

BRIEF DESCRIPTION OF THE DRAWING

Above-mentioned and other features and objects of this invention will become more apparent by reference to the following description taken in conjunction with the accompanying drawing, in which.

DETAILED DESCRIPTION OF THE PREFERRED EMBODIMENT

Figure 1:
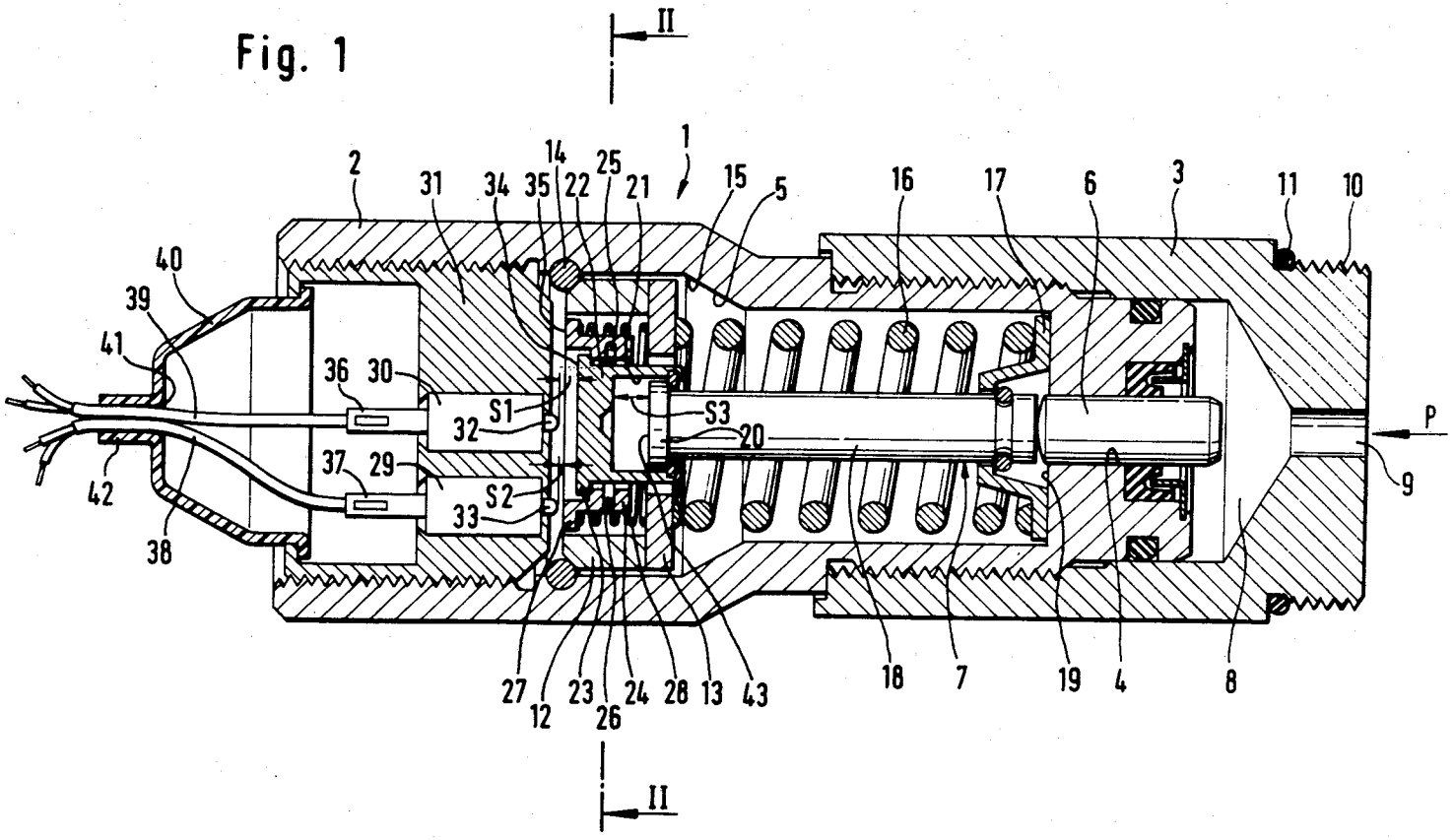
FIG. 1 is a longitudinal sectional view of a switching device according to the present invention.

Referring now to the drawing in detail, and first to FIG. 1 thereof, it may be seen that the reference numeral 1 has been used to identify a housing comprised of housing sections 2 and 3. The housing section 2 includes two coaxial bores 4 and 5. The bore 4 receives in an axially slidable and hydraulically sealed manner a piston section 6 of a first piston 7. A right-hand end, as considered in the drawing, of the piston section 6 extends into a pressure chamber 8 adapted to be pressurized by an input pressure P. The pressure chamber 8 is formed in combination with the housing section 3 that is adapted to be threaded onto the housing section 2 and includes an axial bore 9 extending away from the pressure chamber 8. Furthermore, the housing section 3 has an external thread 10 rendering it possible to thread the switching device into a hydraulic system. The threading of the housing section 3 into the hydraulic system is accomplished with the interposition of a seal ring 11.

Provided in the middle section of the bore 5 of the housing section 2 are two annular holding bodies 12 and 13 stationarily carried in the housing 1 by means of a clamping ring 14 and a bore step 15. A spring 16 bears against the holding body 13 and has another end abutting against a spring plate 17. The spring plate 17 is connected to a piston section 18 of the first piston 7 and engages a housing wall 19 in the rest position of the switching device as shown. Furthermore, it may be seen that the piston sections 6 and 18 of the first piston 7 abut against each other.

The left-hand end of the piston section 18, as considered in the drawing, has an enlarged-diameter head 20 which is introduced into a blind-end bore 21 of a second piston 22 and is embraced by parts of the second piston 22 such as to prevent the head 20 from sliding out of the blind-end bore 21 of the second piston 22. The second piston 22 also carries at its left-hand end an enlarged diameter head 23 serving as an axial stop for a third piston 24. The third piston 24 is designed as an annular piston encompassing a clear radial play together with the second piston 22. The inner circumferential surface of the third piston 24 on the side close to the second piston 22 is provided with an inner circumferential groove 25 seating a shaped steel or plastic ring 26 which acts as a friction member. The left-hand end of the third piston 24, as considered in the drawing, has a radially outwardly extending collar 27 against which a second spring 28 bears. The spring 28 bears with its other end against the holding body 13 that is rigidly connected to the housing.

Figure 2:
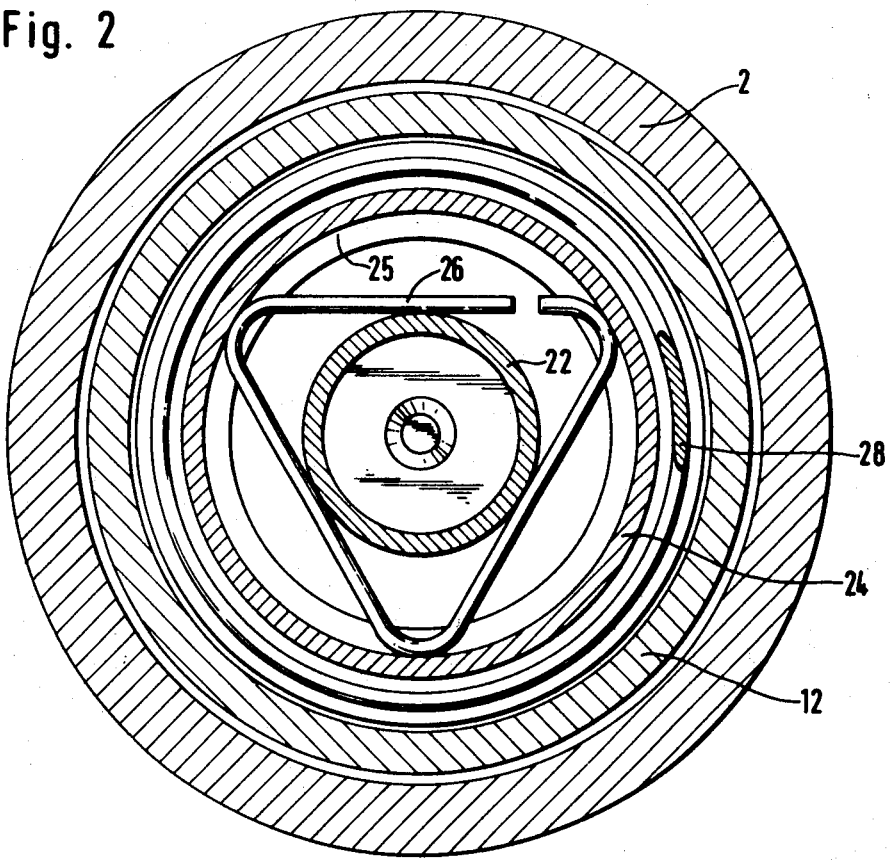
FIG. 2 is a cross-sectional view, on an enlarged scale, of the switching device taken along the line II—II of FIG. 1.

FIG. 2 shows clearly the arrangement or shape of the substantially triangularly shaped steel or plastic ring 26 with its open ends and the pistons 22 and 24. The shaped steel ring 26 has its corners seated in the inner circumferential groove 25 of the third piston 24, while its sides are in multiple point contact with the second piston 22.

A carrier body 31 is threaded down into the left-hand end of the housing section 2. The carrier body 31 receives two electric switching elements 29 and 30. The electric switching elements 29 and 30 are microswitches which, for example, are effective in their non-actuated states for establishing the passage of electric current therethrough. The switches 28 and 30 have their actuators 32 and 33 located opposite an end surface 34 of the second piston 22 and an annular surface 35 of the third piston 24, respectively.

The ends of the electric switching elements 29 and 30 that are remote from the actuators 32 and 33 are provided with terminal lugs 36 and 37 to which electric lines 38 and 39 are connected. At the left-hand end of the housing 1, the bore 5 is closed by a rotationally symmetrical cap 40 having a central opening 41. The opening 41 is defined by a tubular extension 42 through which the electric lines 38 and 39 extend in a clamped relationship for the purpose of achieving a pull-relief. This may be accomplished by using a shaped rubber member which is not shown.

The mode of operation of the switching device described above will be explained in more detail in the following, the starting point being the rest position shown in the drawing in which the input pressure P is zero; the end surface 34 of the second piston is at a maximum distance S1 from the actuator 32, the annular surface of the third piston 24 is at a maximum distance S2 from the actuator 33, and an end surface 43 of the piston section 18 is at a maximum distance S3 from the bottom of the blind-end bore 21 in the second piston 22. With pressure building up in the pressure chamber 8, and on attainment of a determined pressure level, the piston section 6 will be shifted to the left as considered in the drawing, this displacement travel being transmitted to the piston section 18. During this initial displacement motion, the distance S3 between the end surface 43 of the piston section 18 and the bottom of the blind-end bore 21 in the second piston 22 will remain constant, whereas the distance S1 between the end surface 34 and the actuator 32 and the distance S2 between the annular surface 35 and the actuator 33 will be progressively decreased. This is due to the fact that the spring 28 keeps the third piston 24 in abutment with the collar 23 of the second piston 22, whereby the force of the spring 28 also acts on the second piston 22. The end of the second piston 22 embracing the head 20 of the piston section 18 from behind thus remains in abutment with the head 20.

Upon a determined displacement travel S2 which corresponds to an input pressure P in the pressure chamber 8 that is lower than the required minimum pressure in the hydraulic system, the annular surface 35 of the third piston 24 will have reached the actuator 33 of the electric switching element 29, causing an electric making or breaking contact in the electric switching element 29 and thus causing a warning device connected to the electric line 38 and not shown to be turned off. In this position, the distance S1 between the end surface 34 of the second piston 22 and the actuator 32 of the electric switching element 30 will have decreased, with the electric switching element 30, however, being still inactive. With the pressure in the pressure chamber 8 increasing further and the first piston 7 continuing to be displaced, the second piston 22 will initially retain its position because of the action of the shaped plastic or steel ring 26, whereas the distance S3 will decrease until the end surface of the piston section 18 is in abutment with the bottom of the blind-end bore 21. A further increase in the input pressure P causes displacement of the second piston 22 to the left as considered in the drawing, in opposition to the frictional retention force of the shaped plastic or steel ring 26, until the end surface 34 of the second piston 22 is in abutment with the actuator 32 of the electric switching element 30 and opens an electric contact in the line 39, putting the accumulator-charging pump out of operation.

In the event of a pressure decrease in the hydraulic system connected to the pressure chamber 8, the first piston 7 will be displaced in the direction of the pressure chamber 8, thereby initially increasing the distance S3 to its maximum value and retaining the second piston 22 and the third piston 24 in their positions as a result of the action of the friction member 26 and the force of the spring 28. In this position, both electric switching elements 29 and 30 maintain their actuated states. When the maximum distance S3 between the end surface 43 of the piston section 18 and the bottom of the blind-end bore 21 is established, a further rightward displacement of the first piston 7 will cause an activation of the making or breaking contact in the electric switching element 30, turning the pump drive on. With the hydraulic system working without any problems, this in turn results in a pressure increase in the pressure chamber 8, moving the first and the second pistons 7 and 22 to the left until the electric switching element 30 is again opened or closed. If the pressure in the pressure chamber 8 drops further in spite of the pump drive being on, the head 23 of the second piston 22 will abut against the third piston 24 at a predetermined pressure level, whereby the electric making or breaking contact in the electric switching element 29 and a warning device which is not shown will also be actuated.

For this purpose, it is of course necessary for the force of the spring 28 to be greater than the frictional force of the steel or plastic ring 26.

The operation of the electric warning device signals an error condition in the hydraulic system, which is due to a failure of pressure to build up as a result of a leakage or a breakdown of the pump drive or the pump itself.

While we have described above the principles of our invention in connection with specific apparatus, it is to be clearly understood that this description is made only by way of example and not as a limitation to the scope of our invention as set forth in the objects thereof and in the accompanying claims.

We claim:

1. An arrangement for issuing electric control signals in dependence on the pressure of a fluid, comprising a housing defining an internal bore centered on an axis;

a first piston received in said bore for axial movement;

means for applying the pressure of the fluid in one axial direction to the said first piston;

at least one spring urging said first piston in the other axial direction;

a second piston axially movably accommodated in said bore;

means for positively entraining said second piston for joint movement with said first piston only after said pistons have axially moved relative to one another within a predetermined range;

an electric switch interposed into the path of movement of said second piston for actuation by the latter and operative for issuing the electric control signals in response to such actuation; and means for retaining said second piston against movement with said first piston in the absence of positive entrainment to provide for switch actuation hysteresis, including a generally annular and circumferentially incomplete retaining element frictionally engaging said second piston at a plurality of circumferentially spaced locations and having two end portions circumferentially spaced from one another.

2. The arrangement as defined in claim 1, wherein said retaining element is resilient.

3. The arrangement as defined in claim 1, wherein said retaining element extends along a substantially triangular course and has side portions which frictionally engage said second piston at said locations.

4. The arrangement as defined in claim 1, and further comprising means for defining within said housing a recess having radial dimensions exceeding those of said second piston, and at least partially accommodating said retaining element.

5. The arrangement as defined in claim 4; and further comprising a third piston accommodated in said bore for axial displacement therein and having said recess, an additional switch situated in the path of axial displacement of said third piston to be actuated thereby, an additional spring urging said third piston in the actuating direction, and cooperating abutment means on said second and third pistons for engaging one another in a predetermined position of said second and third pistons with respect to each other.

6. The arrangement as defined in claim 5, wherein said second and third pistons actuate said switch and said additional switch, respectively, at different pressures prevailing in said pressure chamber.

7. An arrangement as defined in claim 6, wherein the pressure for actuating said additional switch is lower than that for actuating said switch.

8. The arrangement as defined in claim 5, wherein said switch and said additional switch are operative for establishing electric current flow therethrough in the absence of actuation thereof.

9. The arrangement as defined in claim 5, wherein said third piston is arranged coaxially with said second piston.

10. The arrangement as defined in claim 5, wherein said third piston has an annular configuration.

11. The arrangement as defined in claim 5, wherein said recess is a circumferential groove in said third piston, and wherein said retaining element is a steel ring at least partially received in said groove.

12. The arrangement as defined in claim 5, wherein said recess is a circumferential groove in said third piston, and wherein said retaining element is a synthetic plastic material ring at least partially received in said groove.

13. The arrangement as defined in claim 5, wherein said second and third pistons have end portions close to the respective switches, and wherein said abutment means includes an enlarged-diameter head at said end portion of said second piston and an annular surface at said end portion of said third piston engaging with said head in said predetermined position.

14. The arrangement as defined in claim 1, wherein said applying means includes means for defining a pressure chamber, and means for admitting the fluid into said pressure chamber.

15. The arrangement as defined in claim 14, wherein said first piston includes two sections one of which sealingly extends into said pressure chamber and is operative for abutting the other of said first piston sections.

16. The arrangement as defined in claim 15, further comprising a stationary body in said bore at said second piston and a partitioning wall having a passage therethrough for said first piston; wherein said other section of said first piston carries a spring plate; and wherein said spring extends between said stationary body and said spring plate and urges the latter into abutment with said partitioning wall when the pressure in said pressure chamber drops below a predetermined level.

17. The arrangement as defined in claim 15; and further comprising a third piston accommodated in said bore for axial displacement therein, an additional switch situated in the path of displacement of said third piston to be actuated thereby, cooperating abutment means on said second and third pistons for engaging one another in a predetermined position of said second and third pistons for engaging one another in a predetermined position of said second and third pistons relative to one another, and an additional spring extending between said stationary body and said third piston and urging the latter in the actuating direction toward said additional switch.

18. The arrangement as defined in claim 17, wherein said additional spring exerts a force on said third piston which exceeds the force needed for actuation of said additional switch.

19. The arrangement as defined in claim 14, wherein said admitting means includes a port communicating with said pressure chamber; and wherein said housing has a screw thread for connection thereof to a hydraulic system the fluid pressure in which is to be detected.

20. The arrangement as defined in claim 19, wherein said housing has a section having said screw thread and adapted to be directly threaded into the hydraulic system.

21. The arrangement as defined in claim 1; and further comprising a third piston accommodated in said bore for axial displacement therein, an additional switch situated in the path of axial displacement of said third piston to be actuated thereby, an additional spring urging said third piston in the actuating direction, cooperating abutment means on said second and third pistons for engaging one another in a predetermined position of said second and third pistons relative to one another, and a carrier body threadingly connected with said housing and carrying said switches.

22. The arrangement as defined in claim 21, wherein said second piston has an end face and said third piston has an annular end surface both facing toward said switches; and wherein said switch and said additional switch are so mounted on said carrier body as to be respectively aligned with said end face and with said annular end surface.

23. The arrangement as defined in claim 22, wherein one of said switches is centrally arranged on said carrier body.

24. The arrangement as defined in claim 1, wherein said applying means includes means for defining a pressure chamber and wherein said housing includes a housing body and a cap connected to said housing body at the end of the latter remote from said pressure and having at least one opening for the passage of at least one electric line therethrough.

25. The arrangement as defined in claim 24, wherein said cap is a rotationally symmetrical stamped product having a tubular extension bounding said opening.

26. The arrangement as defined in claim 24; and further comprising means for retaining said electric line at the region of said opening.

* * * * *